US009849320B2

(12) United States Patent
Ringer

(10) Patent No.: US 9,849,320 B2
(45) Date of Patent: Dec. 26, 2017

(54) FIRE PROTECTION SPRINKLER ASSEMBLY

(71) Applicant: Tyco Fire Products LP, Lansdale, PA (US)

(72) Inventor: Yoram Ringer, Providence, RI (US)

(73) Assignee: Tyco Fire Products LP, Lansdale, PA (US)

( * ) Notice: Subject to any disclaimer, the term of this patent is extended or adjusted under 35 U.S.C. 154(b) by 0 days.

(21) Appl. No.: 14/207,377

(22) Filed: Mar. 12, 2014

(65) Prior Publication Data

US 2014/0262357 A1 Sep. 18, 2014

Related U.S. Application Data

(60) Provisional application No. 61/780,717, filed on Mar. 13, 2013.

(51) Int. Cl.
*A62C 37/11* (2006.01)
*A62C 31/02* (2006.01)

(52) U.S. Cl.
CPC ..... *A62C 37/11* (2013.01); *A62C 31/02* (2013.01)

(58) Field of Classification Search
CPC ..... A62C 31/02; A62C 37/08–37/16
USPC ..... 169/37–41, 57, 90, DIG. 3; 239/222.11, 239/498, 516, 524
See application file for complete search history.

(56) References Cited

U.S. PATENT DOCUMENTS 2,076,483 A * 4/1937 Rowley ..... B05B 1/265 169/37
4,796,710 A 1/1989 Job
5,664,630 A 9/1997 Meyer et al.
6,868,916 B2 3/2005 Petersen
7,070,122 B2 * 7/2006 Burcham et al. ..... 239/231
7,201,234 B2 4/2007 Rogers et al.
8,074,725 B2 12/2011 Rogers et al.
8,151,897 B1 4/2012 Meyer et al.
(Continued)

FOREIGN PATENT DOCUMENTS

GB 1349935 A * 4/1974 ..... A62C 37/02
GB 2270840 A * 3/1994 ..... A62C 2/243
WO WO 2013/010098 A2 1/2013

OTHER PUBLICATIONS

"BlazeMaster® CPVC Fire Sprinkler Pipe & Fittings Submittal Sheet," Data Sheet TFP1915, Tyco Fire & Building Products (2 pages) (Jun. 2008).

*Primary Examiner* — Arthur O Hall
*Assistant Examiner* — Cody Lieuwen
(74) *Attorney, Agent, or Firm* — Perkins Coie LLP

(57) ABSTRACT

A sprinkler assembly that includes a sprinkler frame, preferably formed from a plastic material. The sprinkler frame has a proximal portion, a distal portion, an external surface and an internal surface. The internal surface defines an internal passageway extending from an inlet formed in the proximal portion to an outlet formed in the distal portion to define a longitudinal sprinkler axis of the sprinkler assembly. A support member is preferably formed about the distal portion of the frame for supporting a deflector assembly with a pair of projection members. A deflector assembly including a deflector member and a receiving structure is engaged with the projection members to locate the deflector member at a fixed distance from the outlet of the sprinkler frame.

15 Claims, 9 Drawing Sheets

(56) References Cited

U.S. PATENT DOCUMENTS

| | | | | |
|---|---|---|---|---|
| 2003/0066658 | A1* | 4/2003 | MacDonald et al. | 169/37 |
| 2006/0060361 | A1* | 3/2006 | Pounder et al. | 169/37 |
| 2008/0053665 | A1* | 3/2008 | Multer et al. | 169/37 |
| 2009/0126950 | A1 | 5/2009 | Rogers | |
| 2010/0263883 | A1* | 10/2010 | Abels et al. | 169/37 |
| 2011/0030977 | A1* | 2/2011 | Polan | A62C 35/58 169/37 |
| 2011/0127050 | A1* | 6/2011 | Pahila et al. | 169/37 |
| 2011/0214886 | A1* | 9/2011 | Orr | 169/37 |

* cited by examiner

FIRE PROTECTION SPRINKLER ASSEMBLY

PRIORITY DATA

This application claims the benefit of U.S. Provisional Application No. 61/780,717, filed Mar. 13, 2013, which application is incorporated herein by reference in its entirety.

TECHNICAL

The present invention relates generally to fire protection devices and, more specifically, to sprinkler assemblies and the arrangement and operation of their components.

BACKGROUND OF THE INVENTION

Generally, known automatic fire protection sprinklers include a sprinkler frame or body with an inlet that that is connected to a supply of firefighting fluid under pressure. Disposed within the outlet of sprinkler body is a sealing element to prevent the discharge of fluid from the outlet. The sealing element is held in place by a thermally responsive trigger. The trigger is supported directly or indirectly against the sprinkler frame in order to maintain the sealing element within the outlet. Accordingly, in an unactuated state of the sprinkler, the sealing element and trigger are subject to a static load from the fluid pressure.

In response to a sufficiently sized fire or other heat source, the thermally responsive trigger actuates thereby releasing the sealing element to permit discharge of fluid from the sprinkler outlet. The discharged fluid impacts a deflector member disposed at a distance from the outlet for distribution of the fluid. The deflector member can either be disposed in a fixed distance relationship with respect to the sprinkler outlet, i.e., a fixed deflector or alternatively, the deflector can translate with respect to the sprinkler outlet.

U.S. Pat. No. 5,664,630 shows and describes exemplary embodiments of fixed deflector sprinkler assemblies. FIG. 1 of U.S. Pat. No. 5,664,630 shows a one piece frame arm(s) and body sprinkler frame with a knuckle or apex formed at the end of the frame arms. Centrally affixed about the knuckle is a deflector. The deflector includes a central bore that is disposed over an end of the knuckle and secured by swaging. Disposed within the outlet of the sprinkler frame is a plug which is supported by a thermally responsive bulb. The bulb is retained between the plug and the knuckle by a compression screw threaded through the knuckle and acting on the bulb.

These known sprinkler assemblies can present some design limitations and manufacturing complexities. For example, the fixed deflector assembly with the one piece frame, arms and knuckle defines only a single fixed distance between the deflector and the sprinkler outlet. Moreover, each of the fixed and translating deflector assemblies can involve manufacturing and assembly of multiple interconnected components including a compression screw separate from the sprinkler frame, surrounding structure and/or deflector member. It may be desirable to provide sprinkler assemblies that overcome some of these design limitation while presenting a more simplified construction.

DISCLOSURE OF INVENTION

Preferred embodiments of a sprinkler assembly provide for either a pendent or sidewall sprinkler assembly that includes a sprinkler frame, preferably formed from a plastic material, having an outlet for the discharge of a fire fighting fluid, such as water; and a deflector assembly in which the deflector assembly is coupled to the sprinkler frame in a fixed spaced relationship with respect to the sprinkler outlet. Moreover, the preferred arrangement of the sprinkler assembly locates the deflector assembly at a fixed distance to provide a desired water distribution pattern and/or density in the actuated state of the sprinkler assembly; and/or preferably locates the deflector assembly to support a thermally responsive trigger and seal assembly in an unactuated state of the sprinkler assembly.

One preferred embodiment of a sprinkler assembly includes a preferably plastic sprinkler frame having a proximal portion, a distal portion, an external surface and an internal surface. The internal surface defines an internal passageway extending from an inlet formed in the proximal portion to an outlet formed in the distal portion to define a longitudinal sprinkler axis of the sprinkler assembly. A support member is preferably formed about the distal portion of the frame for supporting a deflector assembly, the support member having a pair of projection members. The deflector assembly preferably includes a deflector member and a receiving structure engaged with the projection members to locate the deflector member at a fixed distance from the outlet of the sprinkler frame.

In a preferred embodiment of the support member, the support member includes at least one stanchion disposed about the support member, each stanchion having a proximal receiver portion proximate the outlet and a distal projection that includes a projection portion. The stanchion preferably includes a radial inner component and a radial outer component relative to the sprinkler axis, in which the inner and outer components cooperate to define the receiver portion having an axially extending channel between the inner and outer components. Preferably, the radial inner component is cantilevered off of the support member and extends radially away from a line parallel to the sprinkler axis to define an acute included angle such that the projection portion is biased radially outward into engagement with the receiver structure of the deflector assembly. Preferably, the projection portion defines one of a tab, hook or wedge member.

Another preferred embodiment of the sprinkler assembly includes a plastic sprinkler frame having a proximal portion, a distal portion, an external surface and an internal surface, the internal surface defining an internal passageway extending from an inlet formed in the proximal portion to an outlet formed in the distal portion to define a longitudinal sprinkler axis of the sprinkler assembly. A support member formed about the distal portion of the sprinkler frame has at least one stanchion disposed about the support member. Each stanchion has a proximal receiver portion proximate the outlet and a distal projection portion. The assembly includes a deflector assembly having a proximal portion engaged with the receiver portion and a distal portion having a deflector member. The preferred sprinkler assembly includes a seal assembly disposed in the outlet; and a thermally responsive trigger assembly including a thermally responsive element engaged between the seal assembly and the deflector member. The deflector assembly includes a receiving structure engaged with the distal projection portion of the stanchion to locate the deflector at a fixed distance from the outlet of the sprinkler frame to preferably support the thermally responsive element and the seal under a static fluid load of about 175 psi and more preferably up to about 500 psi.

BRIEF DESCRIPTION OF DRAWINGS

The accompanying drawings, which are incorporated herein and constitute part of this specification, illustrate exemplary embodiments of the invention and, together with the general description given above and the detailed description given below, serve to explain the features of the exemplary embodiments of the invention.

MODES(S) FOR CARRYING OUT THE INVENTION

Figure 1:
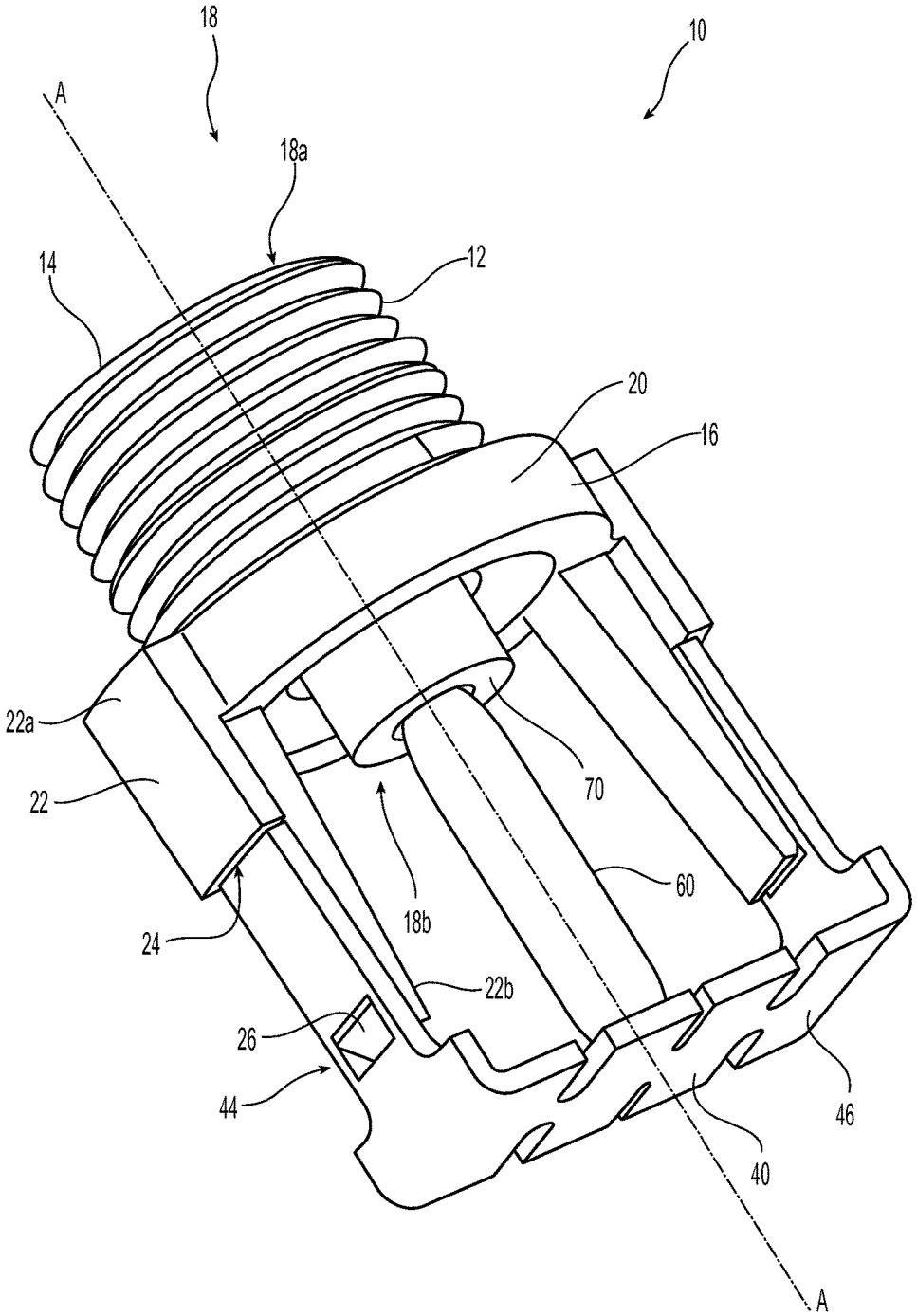
FIG. 1 is an isometric view of a preferred fire sprinkler assembly.
Figure 1A:
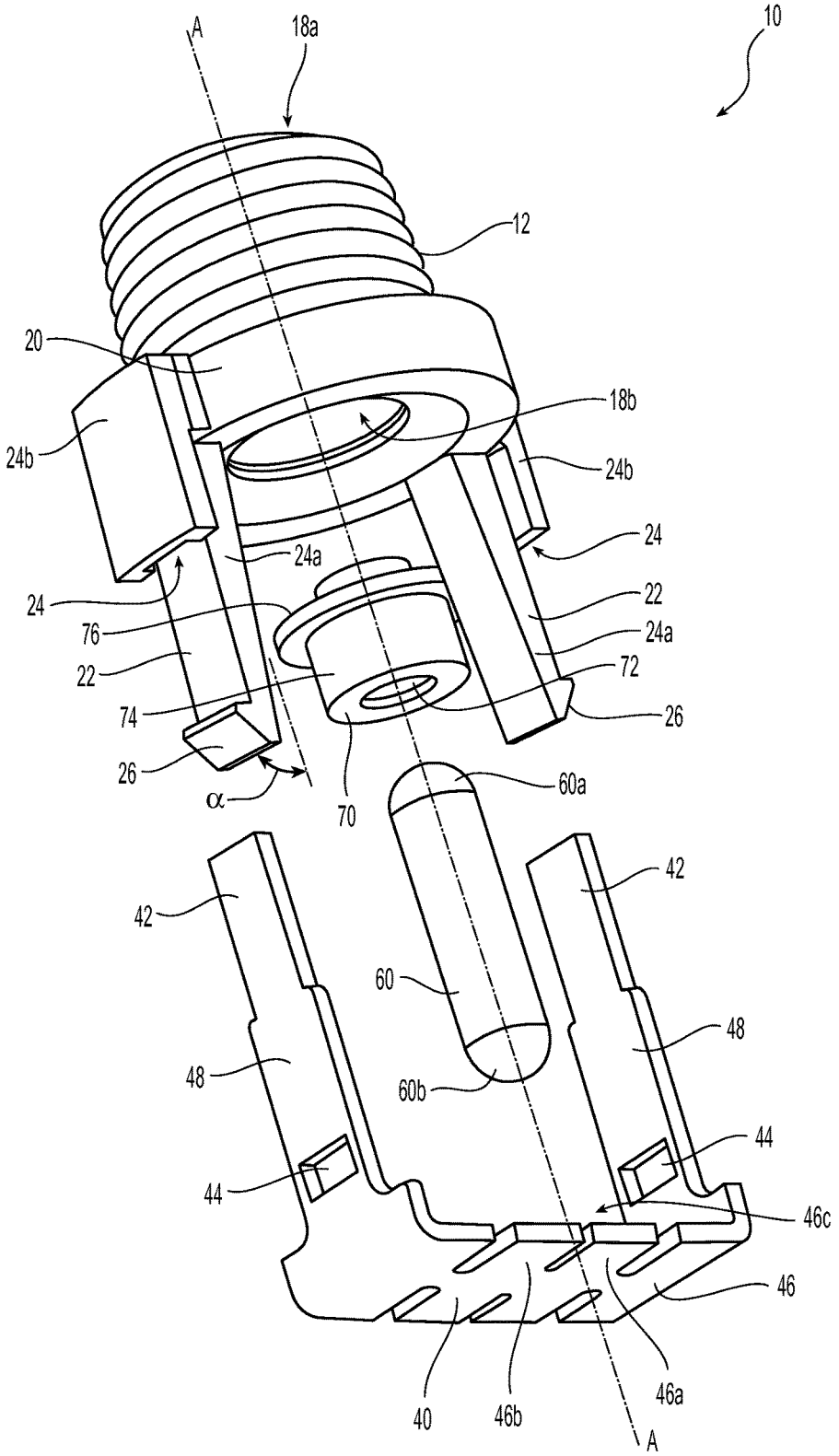
FIG. 1A is an isometric exploded view of the assembly of FIG. 1.
Figure 1B:
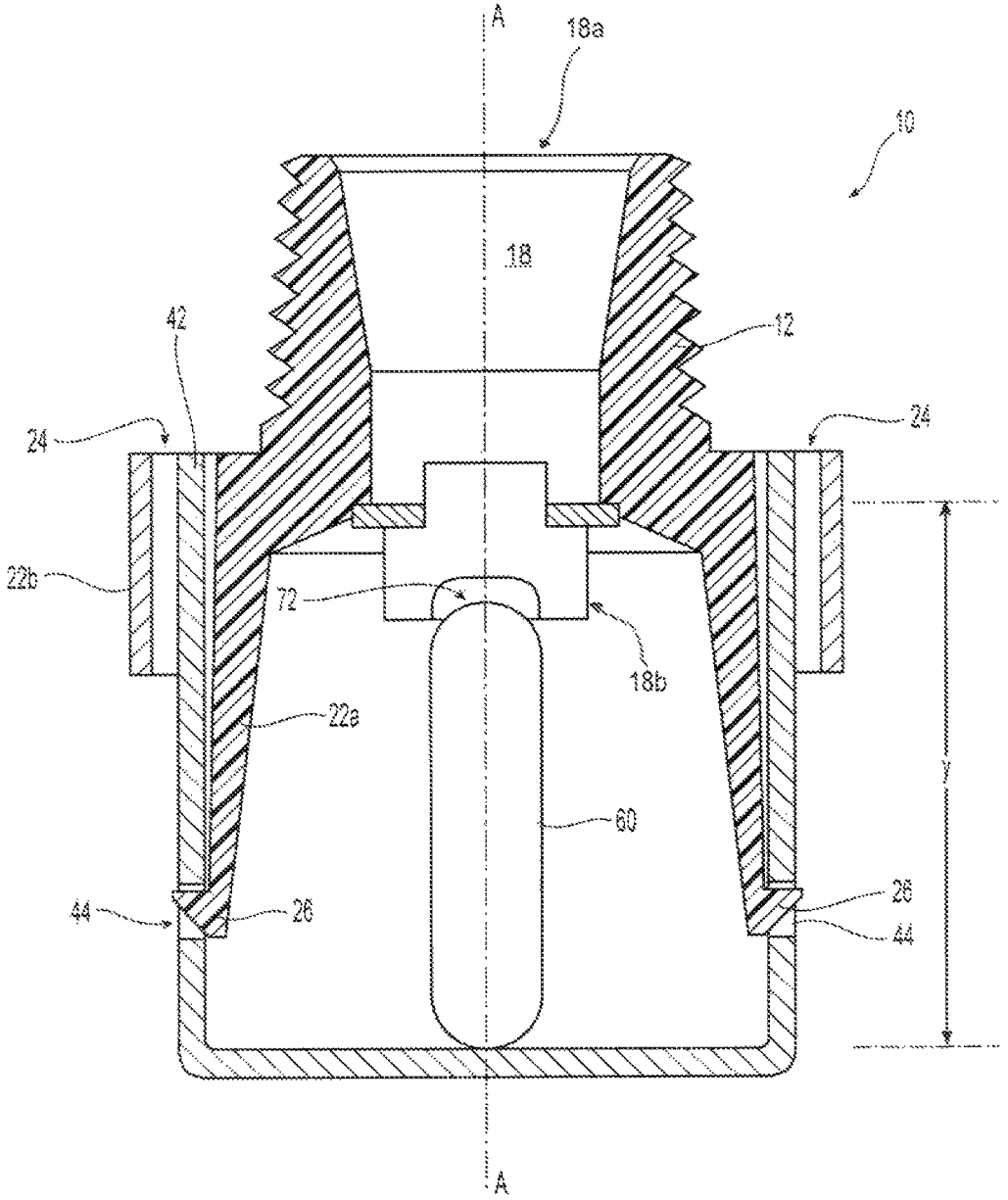
FIG. 1B is a cross-sectional view of the assembly of FIG. 1.

Shown in FIGS. 1 and 1B is a first illustrative embodiment of a preferred fire protection sprinkler assembly 10. The preferred assembly 10 includes a sprinkler frame 12 and a deflector assembly 40 engaged with the sprinkler frame 12, the sprinkler frame having a proximal portion 14 for coupling the sprinkler assembly 10 to a fluid supply pipe network, and a distal portion for supporting the deflector assembly 40. The proximal portion 14 is configured for receipt of a fire fighting fluid, e.g. water, at the inlet 18*a* of an internal fluid passageway 18 for discharge from its outlet 18*b* formed at the distal portion 16 of the sprinkler frame 12. The sprinkler assembly 10 includes a thermally responsive trigger assembly 60 to control operation of the sprinkler assembly 10 between an unactuated state and an actuated state. In the unactuated state, the thermally responsive trigger assembly 60 maintains a seal assembly 70 to seal the outlet 18*b* of the sprinkler frame 12. In response to a sufficient amount of heat from, for example, a fire event, the thermally responsive trigger assembly 60 operates to place the sprinkler assembly and release the seal assembly 70 from the outlet 18*b*. Once actuated, water is discharged from the outlet to impact the deflector assembly 40 for distribution of water in a pattern and/or density for addressing a fire in a desired manner. In operation, the deflector assembly 40 remains fixed relative to the sprinkler frame 12.

The sprinkler frame 12 is preferably formed from a plastic body. The preferred sprinkler frame 12 is a body having internal and external surfaces which individually or together define the proximal portion 14, the distal portion 16 and the internal passageway 18 to further define the longitudinal axis A-A of the sprinkler assembly 10. The plastic body provides an arrangement to connect the sprinkler to a firefighting fluid supply pipe. The sprinkler frame is preferably formed from a plastic material such as, for example, Chlorinated Polyvinyl Chloride (CPVC) material, more specifically CPVC material per ASTM F442 and substantially similar to the material used to manufacture the BLAZEMASTER® CPVC sprinkler pipe and fittings as shown and described in the technical data sheet, TFP1915: "Blazemaster CPVC Sprinkler Pipe and Fittings Submittal Sheet" (June 2008), which is incorporated by reference in its entirety.

In order to couple the sprinkler assembly 10 to an end of a pipe or pipe fitting of a fluid supply line in the piping network, the proximal portion 14 can include an external thread such as, for example, nominally sized tapered National Pipe Thread (NPT). The external thread preferably ranges in nominal sizes: ½ inch to 1 inch NPT. Alternatively, in one preferred configuration and installation of the sprinkler assembly, the proximal portion 14 can include an external course pipe thread for engagement with a corresponding internal threaded pipe fitting such as, for example, a plastic pipe fitting or component as shown and described in PCT Application Publication No. WO 2013/010098 of PCT Application No. PCT/US2012/046717, filed 13 Jul. 2012, which is incorporated by reference in its entirety. Preferably each of the external thread 40 and internal thread 28 is straight pipe thread such as, for example, American Standard straight pipe thread (NPS) or cylindrical thread such as for example, Whitworth-pipe thread, DIN/ISO 228.

The distal portion 16 of the sprinkler frame 12 preferably includes and is more preferably formed with a support member 20. The support member is preferably configured to engage and support the deflector assembly 40 in order to: (i) locate the deflector assembly 40 at a fixed distance to provide a desired water distribution pattern and/or density in the actuated state of the sprinkler assembly 10; and (ii) further preferably locate the deflector assembly to support the trigger assembly 60 and seal assembly 70 in an unactuated state of the sprinkler assembly 10. The support member 20 is preferably integrally formed at the distal end portion 16*a* of the sprinkler frame 12, although the support member may be formed axially anywhere along the sprinkler frame 12 provided it can support and affix the deflector assembly 40 as described herein.

The support member 20 is preferably continuously formed about the sprinkler frame to surround and more preferably circumscribe the sprinkler axis A-A. The support member 20 is preferably formed as a continuous annulus or circular ring. Alternatively, the support member may be formed discontinuously and/or define a non-circular geometry about the sprinkler axis A-A such as, for example, rectangular, square or oval. Preferably radially disposed about the support member 20, extending in the axial direction and preferably distally are one or more posts or stanchions 22. Each stanchion 22 includes proximal portion configured to receive a proximal portion of the deflector assembly 40 and a distal portion configured to engage and preferably secure to a portion of the deflector assembly.

Figure 1C:
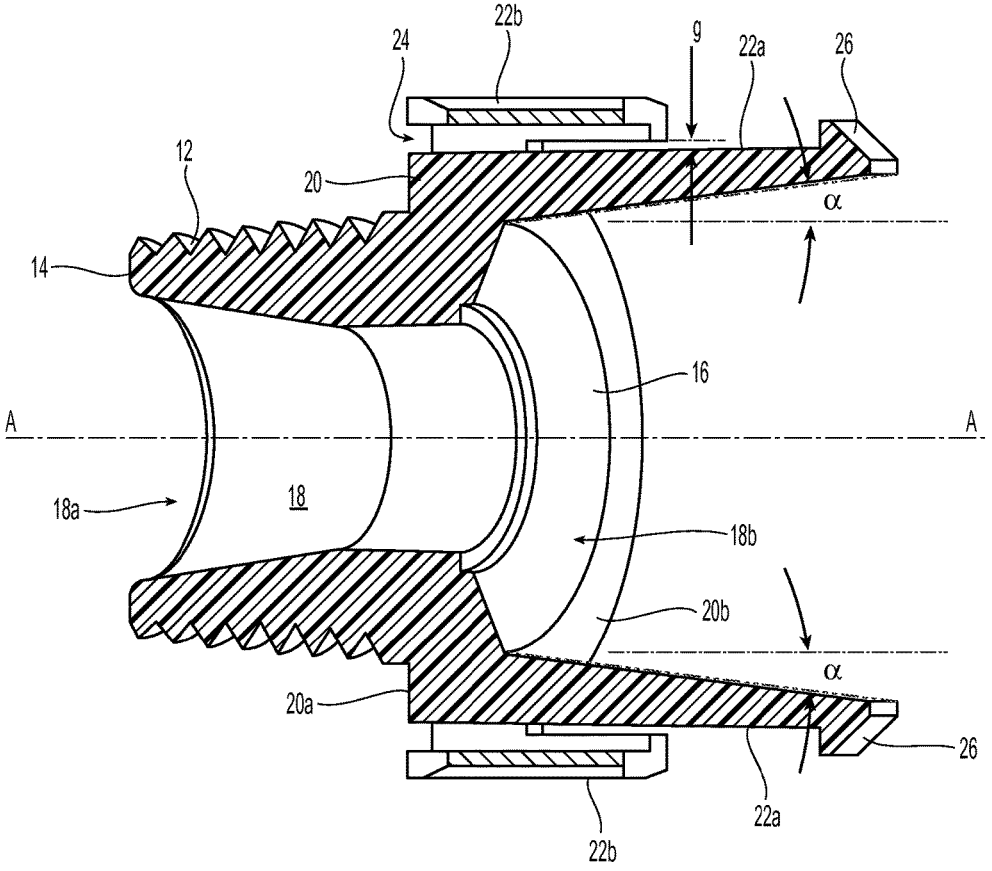
FIG. 1C is a cross-sectional view of a preferred sprinkler frame for use in the assembly of FIG. 1.

With reference to the particular embodiment of the sprinkler assembly 10 shown in FIG. 1A, the sprinkler frame 12 preferably includes a pair of stanchions 22 diametrically opposed about the sprinkler frame outlet 18*b*. The proximal portion of each stanchion 22 defines a receiver 24 sized and configured for receiving a proximal portion 42 of the deflector assembly 40. Shown in FIG. 1C is a cross-sectional view of the sprinkler frame 12. Each preferred stanchion 22 preferably includes a radial inner component 22*a* and a radial outer component 22*b*. The inner and outer components 22*a*, 22*b* cooperate together at the proximal end of the stanchion 22 to define the receiver 24 for receiving the deflector assembly 40. As shown, the preferred radial inner component 22*a* extends axially and preferably distally from the support member 20 of the frame 12. The radial inner component 22*a* is preferably cantilevered off of the support member 20 and further preferably formed so as to extend away from a line parallel to the sprinkler axis A-A at an angle $\alpha$, as seen in FIG. 1C, such that the inner component 22*a* of the stanchion 22 is biased radially outwardly and preferably is flexible radially inwardly. The radial outer component 22*b* is preferably disposed radially outward of the inner component 22*a* to define a gap therebetween and more preferably define the receiver channel 24 for receiving the proximal end portion 42 of the deflector assembly 40. The outer radial component 22*b* extends axially to preferably terminate proximally of the distal end of the inner component 22*a*. The receiver channel 24 preferably extends axially from a preferably open end at the proximal surface 20*a* of the annulus support member 20 to the distal end of radial component 24*b*. Moreover, the outer component 24*b* is preferably joined to the inner component 22*a* so as to further preferably define a gap therebetween so as to provide sufficient flexure between the components 22*a*, 22*b* to facilitate insertion of the proximal portion of the deflector assembly 40 into the receiver 24. Preferably, the components 22*a*, 22*b* define an internal geometry which form the receiver 24 that can accommodate and more preferably correspond to the outer geometry of the proximal portion 42 of the deflector received by the channel 24. For example, the receiver 24 has a rectangular cross-sectional area in which the rectangular cross-sectional area of the proximal portion 42 of the deflector assembly 40 can be disposed.

Referring again to the exploded view of the sprinkler assembly 10 in FIG. 1A, formed preferably at the distal portion of each stanchion 22 is a projection, tab, hook, locker or wedge member 26 for engaging and/or interlocking an opening 44, slot or other receiving structure in the deflector assembly 40. In the assembly of the sprinkler assembly, the proximal portions 42 of the deflector assembly are inserted into the receivers 24 so as to align and locate the wedge members 26 within the slots 44 of the deflector assembly 40 to secure the deflector assembly 40 at a fixed distance from the outlet 18*b* of the sprinkler frame 12 as seen, for example, in FIG. 1B. The stanchions 22 and more particularly the inner components 22*a* of the stanchions preferably bias the wedge members 26 into engagement with the slots 44 of the deflector so as to prevent the axial separation between the sprinkler frame 12 and the deflector assembly 40. In an actuated state and operation of the sprinkler assembly 10, the preferred engagement between the deflector assembly 40 and sprinkler frame 12 is sufficient to be maintained under a water discharge from the outlet 18*b* at a working discharge pressure of, for example, 175 psi.

The sprinkler assemblies described herein may be configured and/or assembled as either a pendent, a concealed pendent or a sidewall sprinkler in which the assembly 10 preferably includes operational components of a fire protection sprinkler, for example as seen in FIG. 1, i) a closure or seal assembly 70 and ii) a thermally responsive trigger assembly 60 which maintain the sprinkler assembly 10 in an unactuated state when coupled to a fire fighting fluid pipe supply. The preferred seal assembly 70 includes a support structure 74. The support structure 74 locates a Belleville seal 76 at the outlet 18*b* of the passageway 18 to prevent fluid from exiting the outlet 18*b* of the passageway 18 until the trigger assembly 60 has actuated. Upon thermal activation of the trigger assembly 60, the sprinkler assembly 10 is placed in an actuated state and the seal assembly is released for the discharge of firefighting fluid.

In the preferred configuration and operation of the sprinkler assembly 10, the deflector assembly 40 is fixed with respect to the sprinkler frame 12. The engagement between the wedge member 26 and the deflector assembly 40 is preferably sufficient to maintain the thermally responsive trigger assembly 60 and seal assembly 70 in their unactuated configurations so as to maintain a static fluid pressure up to about 500 psi. at the seal assembly 70. In a preferred sprinkler assembly arrangement, the trigger assembly preferably includes a thermally responsive link or element in the preferred form of a glass bulb such as, for example, a bulb shown and described in U.S. Pat. No. 4,796,710, which is incorporated by reference in its entirety. Each of the seal assembly 70 and deflector assembly 40 is configured to load and maintain the trigger assembly in a position aligned along and parallel to the sprinkler axis A-A, as seen in FIG. 1. The seal assembly 70 includes a seat portion 72 and the deflector assembly 40 includes a seat portion (not shown) to respectively seat and support the proximal end 60*a* and distal end 60*b* of the trigger assembly 60. The seats 72 can be configured in a manner as shown, for example, in U.S. Pat. No. 4,796,710. In an installed, unactuated configuration, water delivered to the sprinkler assembly 10 loads the seal assembly with a pressure from about 175 psi to about 500 psi. The load is distributed over each of the engagements between the stanchion(s) 22 and the deflector assembly 40. Accordingly, the engagement between the stanchion and the slot of the deflector assembly is preferably configured to maintain the engagement under the static fluid load of about 175 psi and more preferably up to about 500 psi.

Figure 2:
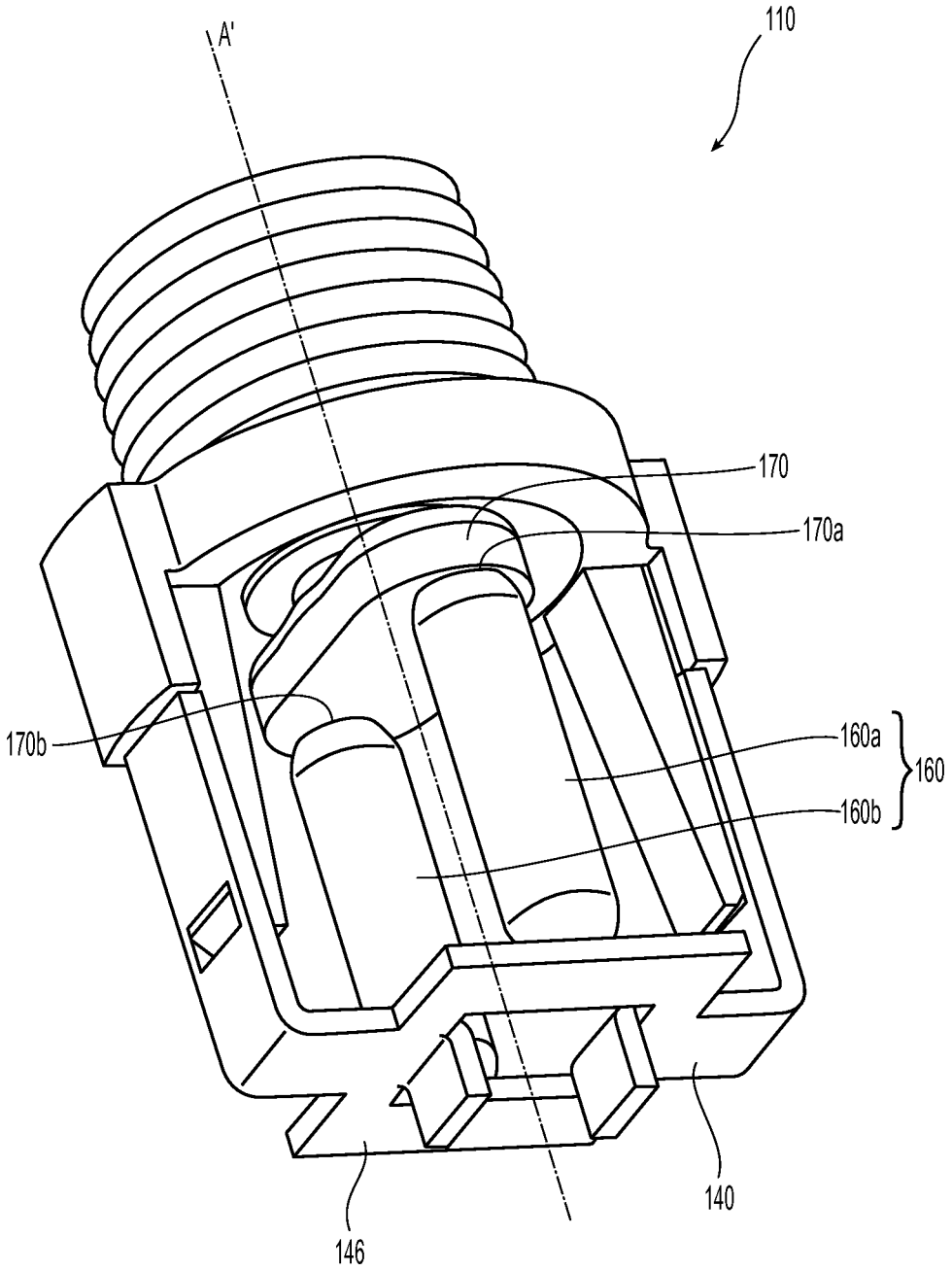
FIG. 2 is an isometric view of another preferred fire sprinkler assembly.
Figure 2A:
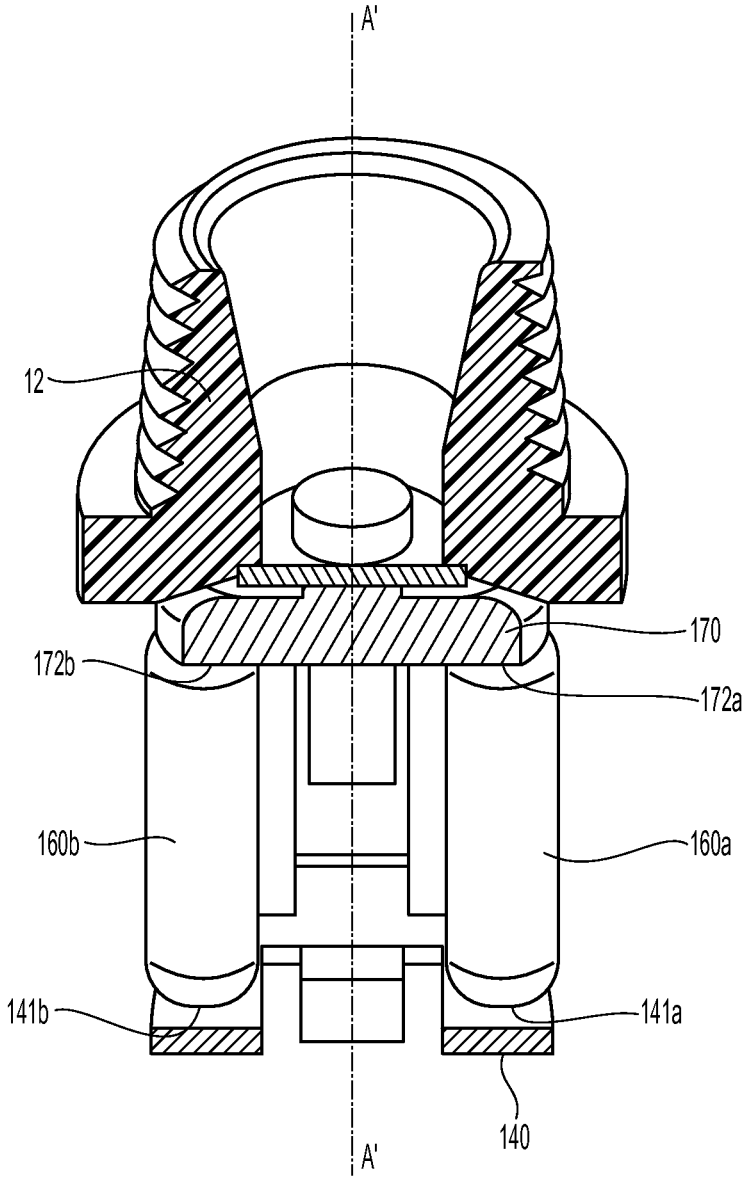
FIG. 2A is an isometric cross-sectional view of the assembly of FIG. 2.

Shown in FIGS. 2 and 2A is an alternate embodiment of the sprinkler assembly 110 having an alternate thermally responsive trigger assembly 160 having two thermally responsive links configured to actuate the sprinkler assembly. The two thermally responsive links or elements preferably include a first thermally responsive bulb 160*a* and a second thermally responsive bulb 160*b*, which can be configured as a bulb shown and described in U.S. Pat. No. 4,796,710, which is incorporated by reference in its entirety. To support each of the bulbs 160*a*, 160*b* in the preferred axial position parallel to the sprinkler axis A'-A', the assembly 110 includes a seal assembly 170 and a deflector assembly 140 with corresponding seats for engaging and supporting the bulbs 160*a*, 160*b*. Shown in FIG. 2A is the seal assembly 170 having first and second seats 172*a*, 172*b* for engaging and supporting the first and second bulbs 160*a*, 160*b* at their proximal ends and the deflector assembly 140 includes first and second seats 141*a*, 141*b* to engage and support the bulbs 160*a*, 160*b* at their distal ends. The seats 172*a*, 172*b*, 141*a*, 141*b* can be configured in a manner as shown, for example, in U.S. Pat. No. 4,796,710.

Referring again to FIG. 1A, the preferred deflector assembly 40 is preferably formed from metal and includes a deflector portion 46 at the distal end of the deflector assembly 40 and one or more extension members or pillars 48 for engaging the sprinkler frame 12 at the receiver 24. In one preferred aspect, the deflector assembly 10 is stamped and bent from a metal such as, for example, a flat or planar bronze blank. The extension members 48 are preferably stamped with the deflector portion 46 so as to locate the deflector portion centrally between the extension members. The extension members 48 are then preferably bent so as to extend preferably orthogonally from the deflector member 46 as shown, for example, in FIG. 1A. Each of the extension members 48 is shaped so as to define the proximal end 42 of the deflector assembly 40 having a configuration that corresponds to the configuration of the receiver 24 of the stanchion 22. As seen in the preferred embodiment of FIG. 1A, the extension members 48 have a rectangular cross-sectional area for receipt in the receiver channel 24 of the stanchion.

In the deflector assembly 40, each of the extension member(s) 48 presents an inner surface 48*a* and an outer surface 48*b* relative to the assembly axis B-B. One or more of the surfaces may be concave or convex. As illustrated in the deflector assembly 10 embodiments, the extension member 48 can define a variable geometry along its axial length or alternatively a constant width. The extension member 48 may taper narrowly in either the proximal or distal direction or both. It may taper at a constant rate or, as seen, taper in a step-wise fashion. The extension members 48 preferably extend parallel to the sprinkler axis A-A to define a substantially constant radius to the assembly axis A-A. Alternatively, the extension members 48 may angle toward or away from the deflector axis B-B as seen, for example, in FIGS. 3E and 3F. Thus, the extension member(s) 48 or portions thereof can extend or be disposed inside or outside the fluid flow path from the sprinkler frame outlet 18*b*.

Moreover, the extension members 48 may present a continuous inner surface to the deflector axis or, alternatively, the extension members 48 may have one or more voids such as, for example, a through hole or slot. The extension member 48 is further preferably formed with the opening 44 for engaging the wedge member 26 of the stanchion 22 to affix the deflector assembly 40 to the sprinkler frame 12. The opening 44 preferably defines a closed form opening centrally aligned along the extension member 48. Accordingly, the opening 44 preferably defines a window having a plurality of surfaces for the surfaces of the wedge member 26 to form the inter-locked engagement previously described. Alternatively, the openings 44 of the extension members may be formed as open-formed geometries, for example, formed along the edges of the extension members 48 provided the slot or opening 44 can engage the stanchion 22 to secure the deflector assembly 10 to the sprinkler frame 12 as described herein. Each of the extension members 48 of the deflector assembly 40 are shown with a single opening or window 44 to define a single fixed distance Y between the deflector member 46 and the outlet 18*b* of the sprinkler frame. Alternatively, the extension members 48 can include a plurality of openings 46'*a*, 46'*b*, for example, as shown in phantom in FIG. 3A axially spaced and aligned along the extension members 48 to selectively define a plurality of deflector member-to-outlet distances for the assembly of the sprinkler assembly 10.

Figure 3:
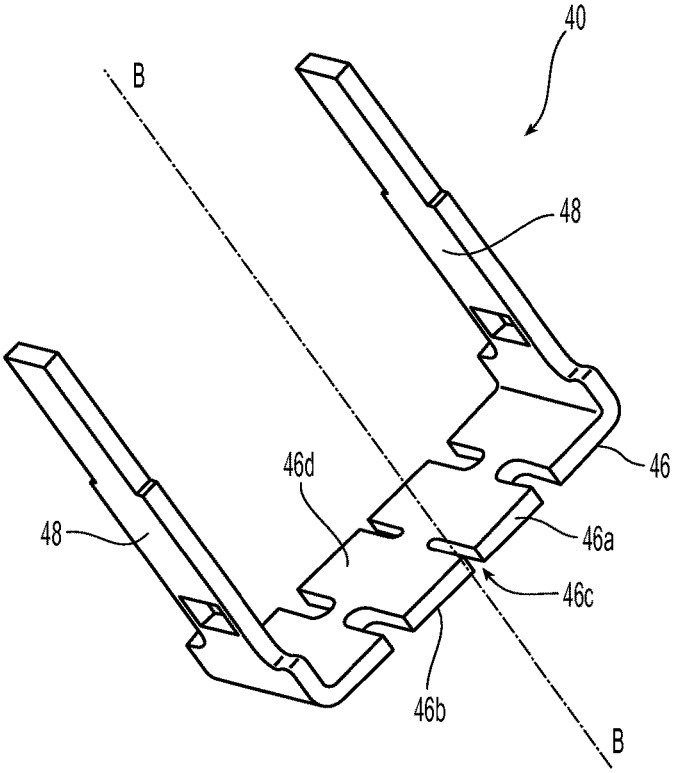
FIGS. 3-3A are various embodiments of a deflector assembly for use in the assembly of FIG. 1.

The deflector member 46 is configured for distributing water in a desired manner to address a fire. Referring to FIG. 3, the deflector member 46 preferably includes two or more spaced apart tines 46*a*, 46*b* defining one or more slot(s) 46*c* in between. The slot 46*c* is preferably open-ended at the deflector perimeter. The tines 46*a*, 46*b* are preferably spaced to define the slot 46*c* with a constant width; however, various configurations of slots and associated tines can be utilized to define the configuration of the deflector.

Figure 3A:
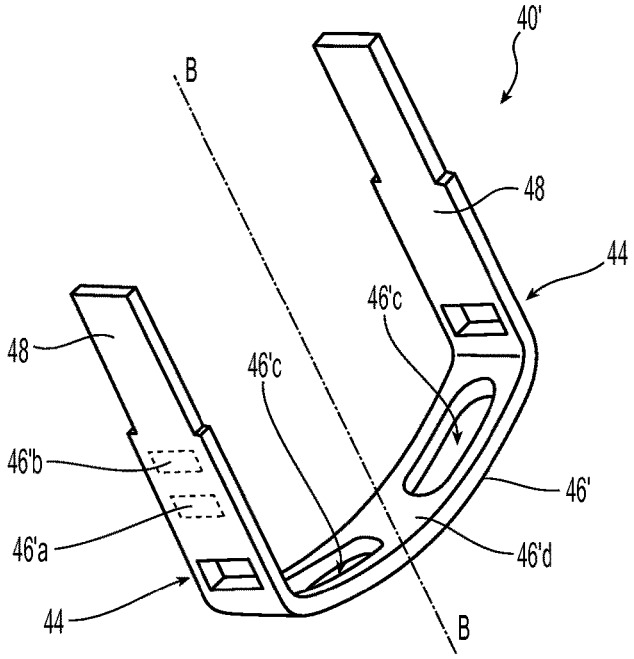

Shown in FIGS. 3, 3A, 3B and 3C are various alternative embodiments of the deflector assembly and deflector members 46, 46', 46", 46'". Shown in each of FIGS. 3 and 3A is a deflector assembly 40, 40' that is configured to seat a single thermally responsive bulb along the deflector axis B-B and the sprinkler axis A-A. The deflector member 46 in FIG. 3 is substantially planar having a plurality of spaced apart tines defining open ended slots. Shown in FIG. 3A is an arcuate or bowed deflector member 46' to present a preferably concave impact surface 46'*d* with respect to the outlet 18*b* of the sprinkler frame 12. The deflector member 46' includes one or more preferably closed ended slots 46'*c* to define the spray distribution pattern of the deflector member 46'.

Figure 3B:
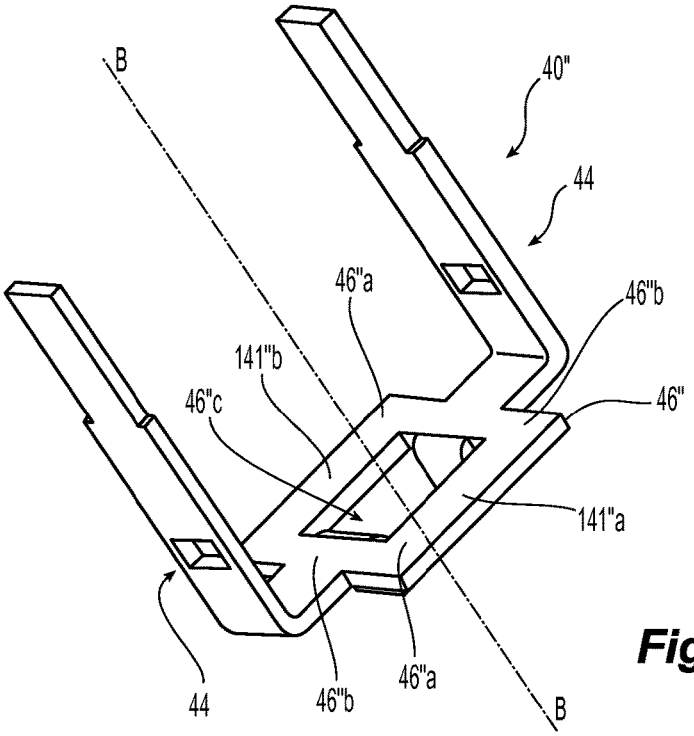
FIGS. 3B-3C are various embodiments of a deflector assembly for use in the assembly of FIG. 2.
Figure 3C:
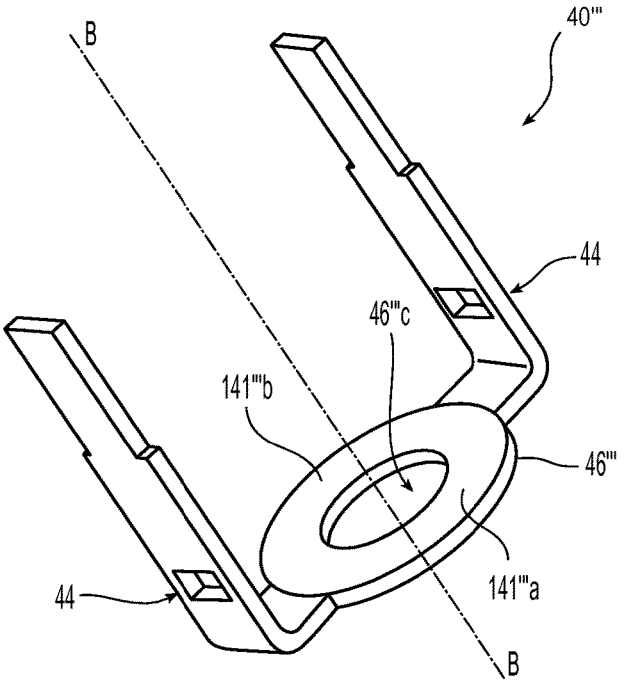
Figure 3E:
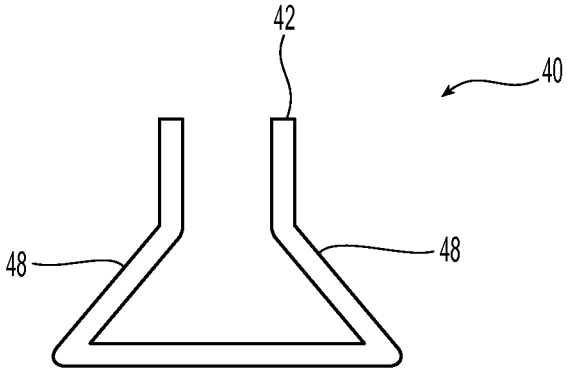
FIGS. 3E-3F are various geometries for use in any one of the deflectors of FIGS. 3-3A and 3B-3C.
Figure 3F:
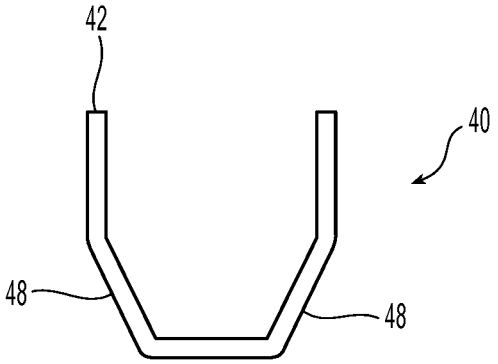

Shown in FIGS. 3B and 3C are embodiments of the deflector assembly 40", 40'" which are preferably configured to seat and support at least two thermally responsive bulbs. Shown in FIG. 3B is a substantially planar deflector member 46" having an outer perimeter defining a rectangular geometry and more preferably a square geometry. The perimeter is preferably defined by a first pair of parallel tines 46"*a* and a second pair of parallel tines 46"*b* orthogonal to the first pair to define a deflector window 46"*c* centered on the deflector axis B-B. The first pair of parallel tines 46"*a* preferably includes a pair of seats 141*a*, 141*b* (not shown) to seat and support the thermally responsive bulbs 160*a*, 160*b*. Shown in FIG. 3C is an alternate embodiment of the deflector member 46'" defining a substantially circular perimeter and a central circular window 46'"C. The circular member 46'" includes a pair of seats 141'"*a*, 141'"*b*, to support the thermally responsive bulbs of a preferred trigger assembly 160.

It is to be understood that the deflector members 46, 146 of FIG. 1 and FIG. 2 are shown generically and that the deflector members can be configured in a manner to distribute fluid (water) and address a fire in accordance with industry accepted standards. Accordingly, the deflector member 46, 146 may define any geometry such that the sprinkler assembly performs in accordance with one or more industry accepted performance standards. For example, the deflector member can be circular and each of the slots extend radially toward the center of the deflector member, which is preferably axially aligned with the sprinkler axis A-A.

Provided the deflector member can be coupled to the sprinkler frame 12 in a manner and operation shown and described herein, the deflector member 46 may be defined by a known deflector geometry which satisfies one or more known industry performance standards. For example, residential automatic fire protection sprinklers are typically designed to specific performance criteria or standards that have been accepted by the industry. The performance criteria establishes the minimum performance standards for a given sprinkler to be considered sufficient for use as a residential fire protection product. For example, Underwriters Laboratories Inc. (UL) "Standard for Safety for Residential Sprinklers for Fire Protection Service" (March 2008) (Rev. April 2012) (hereinafter "UL 1626"), which is incorporated herein in its entirety by reference thereto, is believed to be an accepted industry standard. The National Fire Protection Association (NFPA) also promulgates standards relating to residential fire protection such as, for example, NFPA Standard 13 (2013) (hereinafter "NFPA 13"), which is incorporated in its entirety herein by reference thereto. In order for a residential sprinkler to be approved for installation under NFPA Standards, such a sprinkler typically must pass various tests, for example, tests promulgated by UL under UL 1626, in order to be listed for use as a residential sprinkler. Specifically, UL 1626 generally requires a sprinkler to deliver a minimum flow rate (gallons per minute or "gpm") for a specified coverage area (square feet or "$ft^2$") so as to provide for a desired average density of at least 0.05 $gpm/ft^2$. In one particular embodiment, the deflector member 46 may be configured as a known residential deflector provided it can be coupled to a receiver 24 by an extension member 48 as described herein. Exemplary pendent and horizontal sidewall deflectors are shown and described in U.S. Pat. Nos. 8,074,725; 7,201,234; 8,151,897; and U.S. Patent Application Publication Nos. 20090126950; 20100263883 each of which is incorporated by reference in its entirety.

The geometries of the components of the deflector assembly 40 can define the components individually, but they can also define or characterize the deflector assembly 40 as a whole. In the illustrative embodiments of FIG. 3, the deflector member 46 is shown with its impact surface 46*d* normal or orthogonal to the deflector assembly axis B-B. Alternatively the extension members 48 can be configured to angle the deflector member 46 to define an obtuse included angle between the impact surface 46*d* and the assembly axis B-B. Thus, the components of the deflector assembly 40, their surfaces and or voids can individually or collectively define deflection surfaces of the assembly, which in combination with the deflector member 46, can define the performance of the sprinkler assembly 10.

Referring again to the illustrative cross-sectional view of the sprinkler assembly 10 in FIG. 1B, the fluid passage can include a tapering portion that tapers narrowly in the distal direction and a constant diameter portion that is distal of and contiguous with the tapering portion. The passageway may alternatively have a constant width or taper at a constant rate, variable rate or combinations thereof along its entire length. The internal surface of the sprinkler frame 12 defines an internal fluid passageway 18 that extends axially from the proximal portion 14 preferably into the distal portion 16. The fluid passage 18 has an inlet 18*a* into which water is supplied and an outlet 18*b* from which the water is discharged for impacting the deflector assembly 40.

The fluid passage 18, inlet 18*a* and outlet 18*b* preferably define a sprinkler constant or K-factor which approximates the flow rate to be expected from an outlet of a sprinkler based on the square root of the pressure of fluid fed into the inlet of the sprinkler. As used herein and in the sprinkler industry, the K-factor is a measurement used to indicate the flow capacity of a sprinkler. More specifically, the K-factor is a constant representing a sprinkler's discharge coefficient that is quantified by the flow of fluid in gallons per minute (GPM) through the sprinkler passageway divided by the square root of the pressure of the flow of fluid fed to the sprinkler in pounds per square inch gauge (PSIG.). The K-factor is expressed as $GPM/(PSI)^{1/2}$. Industry accepted standards such as, for example, the National Fire Protection Association (NFPA) standard entitled, "NFPA 13: Standards for the Installation of Sprinkler Systems" (2010 ed.) ("NFPA 13") provide for a rated or nominal K-factor or rated discharge coefficient of a sprinkler as a mean value over a K-factor range. As used herein, "nominal" describes a numerical value, designated under an accepted standard, about which a measured parameter may vary as defined by an accepted tolerance ranging. The sprinkler frame and its internal passage 18 and inlet passage 18*b* can be configured to define a K-factor ranging from a nominal 4.1 to a nominal 5.6 $GPM/(PSI)^{1/2}$.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claimed is:

1. A sprinkler assembly comprising:

a sprinkler frame having a proximal portion, a distal portion, an external surface and an internal surface, the internal surface defining an internal passageway extending from an inlet formed in the proximal portion to an outlet formed in the distal portion to define a longitudinal sprinkler axis of the sprinkler assembly;

a support member formed about the distal portion, the support member having at least one stanchion disposed radially about the support member having a proximal receiver portion proximate the outlet and a distal projection portion, the proximal receiver portion disposed radially about the support member; and a deflector assembly including a proximal portion engaged with the receiver portion of the at least one stanchion, and a distal portion having a deflector member, the deflector assembly including a receiving structure engaged with the distal projection portion of the stanchion to locate the deflector member at a fixed distance from the outlet of the sprinkler frame in an unactuated state of the sprinkler assembly and remain at the fixed distance in an actuated state of the sprinkler assembly, wherein the proximal receiver portion includes a radial inner component and a radial outer component disposed radially outward of the radial inner component to define an axially extending channel between the radial inner and outer components, wherein the radial inner component is cantilevered off of the support member and extends radially away from a line parallel to the sprinkler axis to define an acute included angle such that the projection portion is biased radially outward into engagement with the receiver structure of the deflector assembly.

2. The sprinkler assembly of claim 1, wherein the radial outer component is joined to the radial inner component to define a gap and a flexure between the components.

3. The sprinkler assembly of claim 1, wherein the axially extending channel is open at a proximal end and at a distal end for receipt of the proximal portion of the deflector assembly.

4. The sprinkler assembly of claim 1, wherein the projection portion defines one of a tab, hook or wedge member.

5. The sprinkler assembly of claim 1, wherein the support member is formed integrally with the distal portion of the sprinkler frame.

6. The sprinkler assembly of claim 1, wherein the support member defines a circular geometry about the sprinkler axis.

7. The sprinkler assembly of claim 1, wherein the at least one stanchion includes a plurality of stanchions diametrically opposed about the support member, and the deflector assembly includes a plurality of extension members extending from the deflector member, the extension members being received in the receiver portion of the stanchion.

8. The sprinkler assembly of claim 1, wherein the at least one stanchion includes two stanchions diametrically opposed about the passageway.

9. A sprinkler assembly comprising:

a plastic sprinkler frame having a proximal portion, a distal portion, an external surface and an internal surface, the internal surface defining an internal passageway extending from an inlet formed in the proximal portion to an outlet formed in the distal portion to define a longitudinal sprinkler axis of the sprinkler assembly;

a support member formed about the distal portion of the sprinkler frame, the support member having a pair of receiving channels formed radially about the support member and a pair of projection members; and a deflector assembly including a deflector member and a pair of extension members for receipt in the receiving channels and a receiving structure engaged with the projection members to locate the deflector member at a fixed distance from the outlet of the sprinkler frame, wherein the pair of projection members are diametrically opposed about the passageway, wherein the pair of extension members of the deflector assembly are formed about the deflector member, the receiver structure being defined by a closed form opening formed in each extension member, each of the projection members being received in one of the closed form openings.

10. The sprinkler assembly of claim 9 further comprising:

a seal assembly disposed in the outlet; and a thermally responsive trigger assembly to control operation of the sprinkler assembly between an unactuated state and an actuated state, the thermally responsive trigger assembly including a thermally responsive element engaged between the seal assembly and the deflector member, the deflector member being located to support the thermally responsive element and the seal under a static fluid load of about 175 psi and more preferably up to about 500 psi in the unactuated state of the sprinkler assembly, the deflector member remaining at the fixed distance in the actuated state of the sprinkler assembly.

11. The sprinkler assembly of claim 10, wherein the thermally responsive trigger assembly includes two thermally responsive bulbs spaced about and parallel to the sprinkler axis.

12. The sprinkler assembly of claim 10, wherein the support member includes a plurality of radial inner components and a plurality of radial outer components relative to the sprinkler axis, the inner and outer components cooperating to define the pair of receiving channels as a pair of axially extending channels between the inner and outer components.

13. The sprinkler assembly of claim 10, wherein the pair of projection members define one of a tab, hook or wedge member.

14. The sprinkler assembly of claim 10, wherein the support member is formed integrally with the distal portion.

15. The sprinkler assembly of claim 9, wherein the deflector member is centered between the pair of extension members.

* * * * *